US008740657B2

(12) United States Patent
Byron et al.

(10) Patent No.: US 8,740,657 B2
(45) Date of Patent: Jun. 3, 2014

(54) CABLE LUG PAD

(75) Inventors: Eldridge R. Byron, Murfreesboro, TN (US); Matthew A. Williford, Nashville, TN (US)

(73) Assignee: Schneider Electric USA, Inc., Palatine, IL (US)

( * ) Notice: Subject to any disclaimer, the term of this patent is extended or adjusted under 35 U.S.C. 154(b) by 0 days.

(21) Appl. No.: 13/446,686

(22) Filed: Apr. 13, 2012

(65) Prior Publication Data

US 2013/0273771 A1 Oct. 17, 2013

(51) Int. Cl.
*H01R 11/01* (2006.01)

(52) U.S. Cl.
USPC ..... 439/777

(58) Field of Classification Search
USPC ..... 439/777, 801
See application file for complete search history.

(56) References Cited

U.S. PATENT DOCUMENTS 5,195,912 A * 3/1993 Lintott ..... 439/685
6,971,926 B1 * 12/2005 Walton ..... 439/798
7,780,488 B2 * 8/2010 Robertson ..... 439/777

* cited by examiner

*Primary Examiner* — Neil Abrams
*Assistant Examiner* — Phuongchi T Nguyen
(74) *Attorney, Agent, or Firm* — Locke Lord LLP

(57) ABSTRACT

An electrical system includes an electrical device mounted within an electrical enclosure. A electrical cable is coupled to an electrical junction of the electrical device via a cable lug, the cable lug having at least two lug holes. A lug pad attaches the cable lug to the electrical device and has at least two pad holes. Each of the pad holes is aligned with a respective one of the lug holes, and at least one of the lug holes and the pad holes is a slotted hole for permitting angular adjustable positioning of the cable lug relative to the lug pad.

14 Claims, 7 Drawing Sheets

CABLE LUG PAD

FIELD OF THE INVENTION

This invention is directed generally to switchgear, and, more particularly, to a lug assembly having radiused slots.

BACKGROUND OF THE INVENTION

In the electrical industry, electrical cables are mounted to different types of electrical devices using cable lugs. Generally, electrical devices that use cables with lugs include low voltage and medium voltage devices (e.g., 600 volts to 69 kVolts), such as circuit breakers and switches. For example, switches or circuit breakers are typically electrically and physically connected to electrical cables via cable lugs. In some devices, lug pads are used to further facilitate the connection to the cables, which are typically difficult to bend.

Present lug pads are limited to configurations in which only holes are used for connecting cable lugs to electrical devices. For example, a current configuration requires lug pads to have a double-hole pattern that is identical to a bolt-hole pattern of respective cable lugs. The double-hole pattern, in contrast to a single hole, is required to provide necessary mounting strength and additional current paths between the lug pads and the cable lugs. Accordingly, to mount cable lugs to lug pads, the double-hole cable lugs and the lug pads must be positioned such that the two patterns are aligned with each other. This requirement proves difficult in the field, because it forces an installer to bend and maneuver cables in tight spaces of electrical cubicles for achieving necessary alignment between the holes of the lug pad and the bolts of the cable lug.

Bending space in confined spaces, such as electrical cubicles, is a limited and very expensive commodity. The minimum bending radii of cable is defined by the National Electrical Code ("NEC"). In accordance with NEC calculations, the cable bending required by present electrical cubicles, to align cable lugs and lug pads, unnecessarily increases the required bending space, and, consequently, the size of the electrical cubicle. Space is always at a premium for enclosed electrical equipment. Additionally, cable cost is unnecessarily increased by requiring cables of longer length for bending the cable lug in position relative to the lug pad.

SUMMARY OF THE INVENTION

In an implementation of the present invention, at least one slot of a lug pad or a cable lug is radiused to provide a positional mount of the cable lug to the lug pad. The radiused slot helps reduce cable bending space inside an electrical enclosure.

In another implementation of the present invention, an electrical system includes an electrical device mounted within an electrical enclosure. An electrical cable is coupled to an electrical junction of the electrical device via a cable lug, the cable lug having at least two lug holes. A lug pad attaches the cable lug to the electrical device and has at least two pad holes. Each of the pad holes is aligned with a respective one of the lug holes, and at least one of the lug holes and the pad holes is a slotted hole for permitting angular adjustable positioning of the cable lug relative to the lug pad.

In another alternative implementation of the present invention, an electrical system includes an electrical device and a cable lug. The cable lug is attached to the electrical cable. The cable lug has a barrel, in which an end of the electrical cable is insertably attached, and a tang with at least two holes. A lug pad has at least two slotted holes with a radiused shape, the slotted holes being symmetrically oriented on the lug pad and permitting angular adjustment of the cable lug relative to the lug pad throughout a plurality of mountable positions. At least two fasteners mount the cable lug to the lug pad such that the barrel of the cable lug is angled relative to a linear distance between the two slotted holes.

In yet another alternative implementation of the present invention, a method is directed to attaching an electrical cable to an electrical junction of an electrical device. The method includes providing a cable lug and a lug pad, the cable lug being attached to an electrical cable and having at least two lug holes, the lug pad having at least two pad holes. The method further includes adjusting the cable lug in an angled position relative to the lug pad while each of the at least two lug holes is aligned with a respective one of the at least two pad holes. The cable lug is secured to the lug pad in the angled position.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Figure 1:
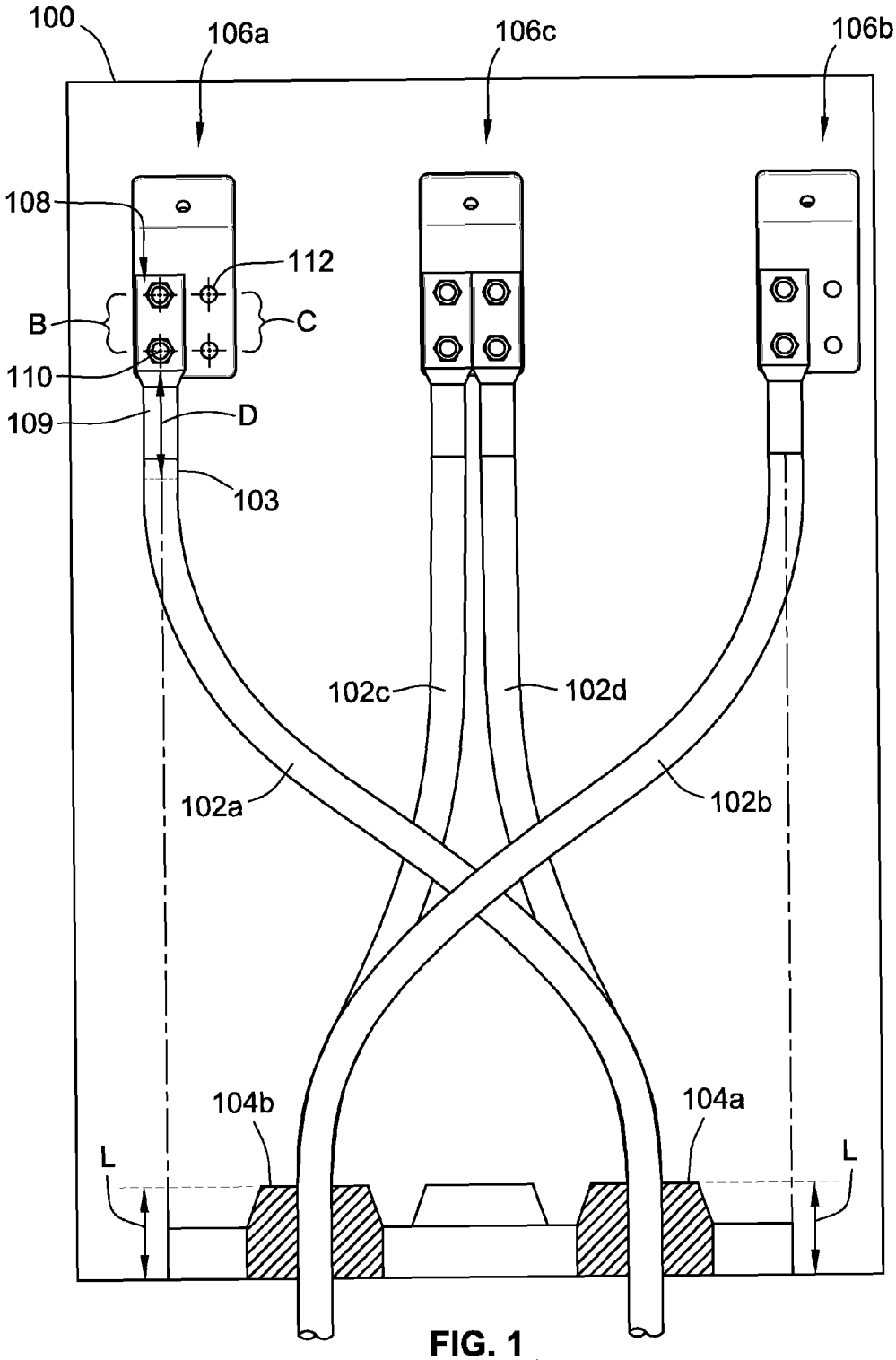
FIG. 1 (PRIOR ART)
FIG. 1 is a front view illustration of a conventional lug pad connection.

Referring to FIG. 1, a typical lug pad connection of the known art is illustrated in which an electrical enclosure 100 has a plurality of electrical cables 102*a*-102*d* that are routed through cable conduits 104*a*, 104*b* and mounted to conventional lug pads 106*a*-106*c*. The electrical cables include a left cable 102*a* and a right cable 102*b*, each correspondingly mounted to a left pad 106*a* and a right pad 106*b*. The cable conduits 104*a*, 104*b* include a right conduit 104*a* and a left conduit 104*b*, which are located near a bottom end of the electrical enclosure 100 and which include linear portions that are vertically oriented over a distance L. Center cables 102*c*, 102*d* are mounted to a center pad 106*c*.

For ease of understanding, only the left connection between the left electrical cable 102*a* and the left pad 106*a* will be described. However, it is understood that the right connection between the right cable 102*b* and the right pad 106*b* and the center connection between the center cables 102*c*, 102*d* and the center pad 106*c* are substantially similar, if not identical, to the left connection.

The left cable 102*a* has a cable lug 108 that is fastened directly to the left pad 106*a* via a plurality of bolts 110. Specifically, the bolts 110 are inserted through respective lug holes of the cable lug 108 and are received by respective circular holes 112 of the left pad 106*a*. To provide adequate mounting strength, the connection between the cable lug 108 and the left pad 106*a* is required to have at least two bolts 110 fastened within respective circular holes 112 with respective nuts (not shown).

The connection of the cable lug 108 to the left pad 106*a* requires a field installer to maneuver the left cable 102*a* in position, by twisting or bending the left cable 102*a* such that the pattern of bolts 110 is aligned with the pattern of circular holes 112. For example a vertical distance B between a pair of bolts 110 must be vertically overlapping with a vertical distance C between a pair of corresponding circular holes 112.

The required vertical alignment between corresponding bolts 110 and circular holes 112 can be achieved only by having a connecting end 103 of the left cable 102*a* placed in a vertical position relative to the bottom end (or floor) of the electrical enclosure 100. The connecting end 103 is received within a barrel 109 of the cable lug 108. The vertical position of the connecting end 103 and the barrel 109 is required over a distance D. In-between the distances D (of the connecting end 103 and barrel 109) and L (of the vertical linear portion of the right conduit 104*a*), the left cable 102*a* is angularly bent to achieve the required mounting between the cable lug 108 and the left pad 106*a*.

Figure 2:
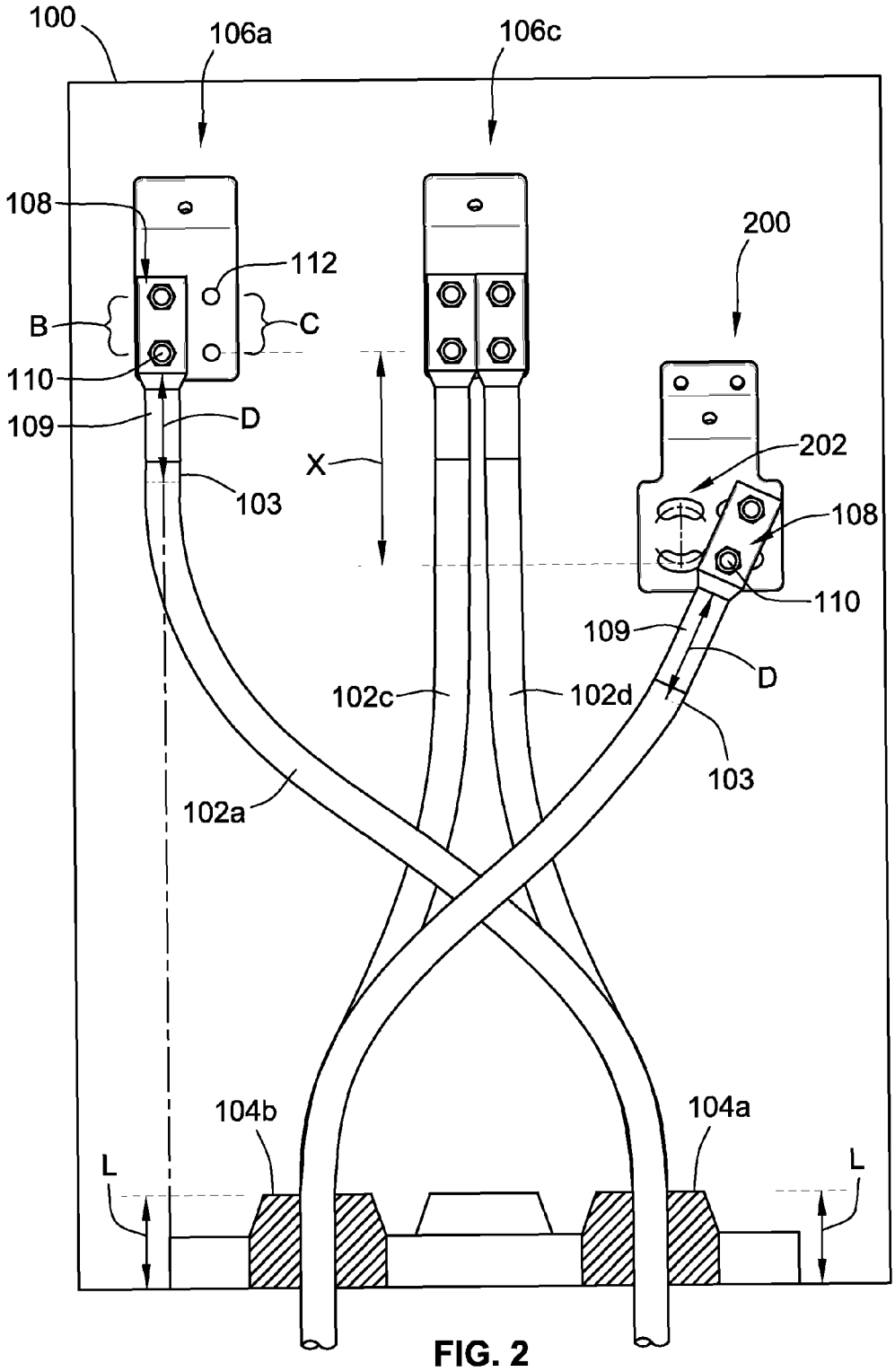
FIG. 2 is a front view illustrating a lug pad connection with slotted holes.

Referring to FIG. 2, in the present invention the right pad 106*b* of the known art has been replaced with a slotted lug pad 200. One difference between the right pad 106*b* and the slotted pad 200 is that the slotted pad 200 has radiused-shaped slotted holes 202, instead of circular holes 112. The radiused slotted holes 202 allow angular adjustment of the right cable 102*b* relative to the slotted pad 200 (which was not possible if the conventional right pad 106*b* was used). Specifically, the radiused slotted holes 202 permit angular adjustable positioning such that, for example, the distance D is angled relative to the previous vertical orientation.

Based on the angular adjustable positioning, the right connection (with the slotted pad 200) can be much closer to the bottom end of the electrical enclosure 100. Specifically, bending space required within the electrical enclosure 100 for mounting the right cable 102*b* decreases in accordance with a distance X when using radiused slotted holes 202, instead of using circular holes 112. The requirement of vertical alignment over distances B and C when using circular holes 112 is no longer necessary. The radiused slotted holes, as explained in more detail below, removes that requirement and provides several advantages.

For example, one advantage provided by the radiused slotted holes 202 is that it eliminates one of the bends in the right cable 102*b*. In turn, this reduces the required height in the electrical enclosure 100, between the bottom end (or floor) of the electrical enclosure 100 and the position of the slotted pad 200. For example, using conventional cable bending space allowance calculations and assuming a cable size of 500 kcmil with a cable outside diameter of 1.53 inches, creating an inside bend radius of 18.36 inches, and having the right pad 106*b* spaced apart from the center pad 106*c* at a distance of 7.88 inches, the height reduction X is approximately 16.62 inches, reducing an initial height of 46 inches to 29.39 inches. Assuming a total enclosure height of about 90 inches, such a reduction can free up to 18.5% of the space in the enclosure.

Another advantage provided by the radiused slotted holes 202 is that it reduces load stresses on attachment between the slotted pad 200 and a bus bar (such as the bus bar 515 shown in FIG. 5*b*), which provides the mounting attachment between the slotted pad 200. The reduction in load stress is achieved because the angled orientation of the right cable 102*b* causes less load stress than the vertical orientation of the left cable 102*a*. Specifically, the left cable 102*a* tends to force the left pad 106*a* in a counter-clockwise direction based on the natural tendency of the left cable 102*a* to bend back in a linear position near the left pad 106*a*. In contrast, the right cable 102*b* is linearly oriented near the right pad 106*a* and, as such, does not tend to bend near the right pad 106*a*. Consequently, the right cable 102*b* causes less load stress on the right pad 106*a* than the left cable 102*a* causes on the left pad 106*a*. Yet another advantage of the radiused slotted holes 202 is that it provides numerous mounting positions for the field installer (instead of a single position). As such, the attachment of electrical cables in the field is easier for the field installer.

Figure 3A:
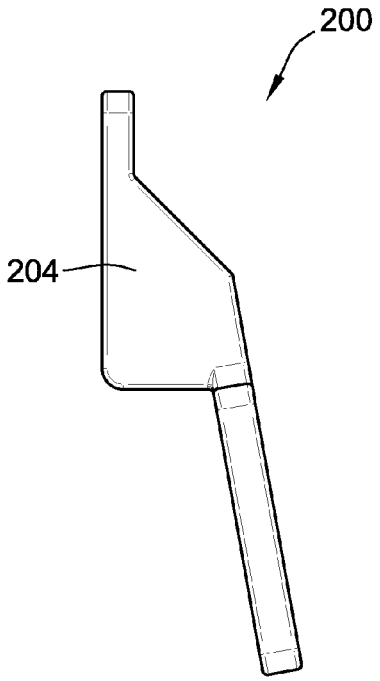
FIG. 3A is a side view of a slotted lug pad according to an embodiment of the present invention.
Figure 3B:
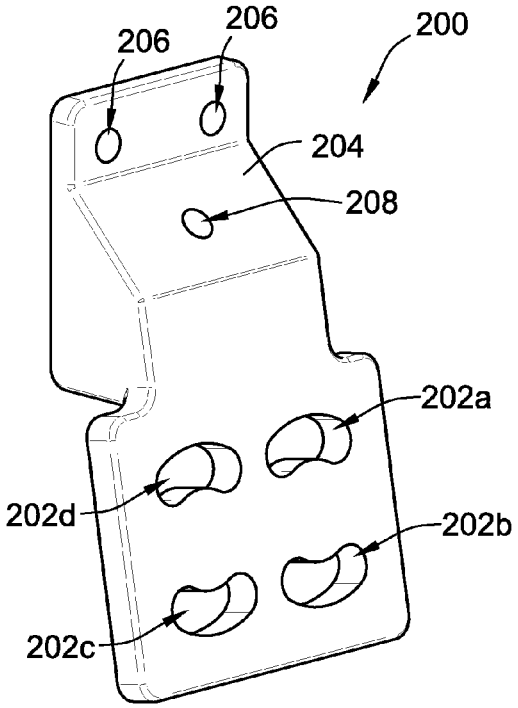
FIG. 3B is a perspective view of the slotted lug pad of FIG. 3A.
Figure 3C:
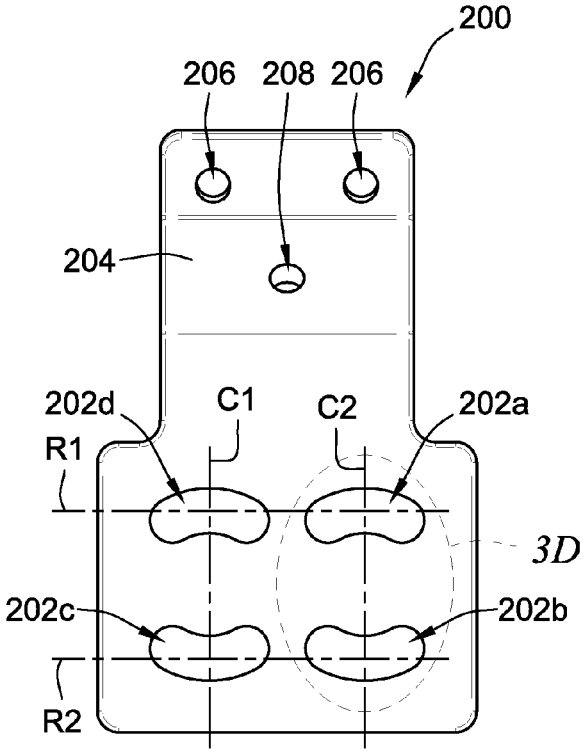
FIG. 3C is a front view of the slotted lug pad of FIG. 3A.

Referring to FIGS. 3A-3C, the slotted pad 200 has four slotted holes 202*a*-202*d* symmetrically arranged in a matrix pattern of two rows R1, R2 and two columns C1, C2. A first pair of slotted holes 202*a*, 202*b* is located in a second column C2 and a second pair of slotted holes 202*c*, 202*d* is located in a first column C1. The slotted pad 200 can be made of any suitable conductor or metal, including copper and aluminum.

Figure 5A:
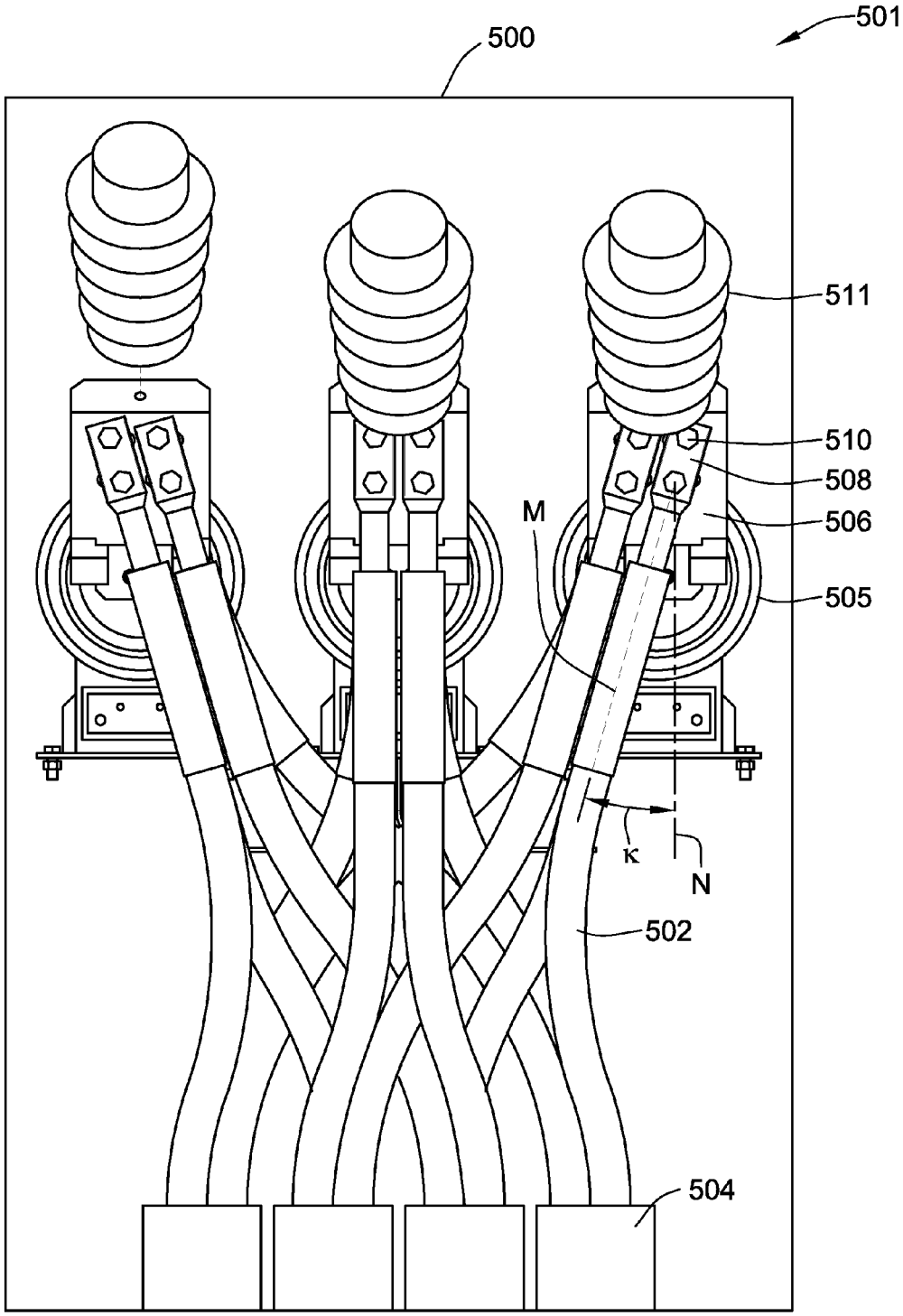
FIG. 5A is a front view of an electrical system in which electrical cables are mounted to electrical devices via slotted lug pads.
Figure 5B:
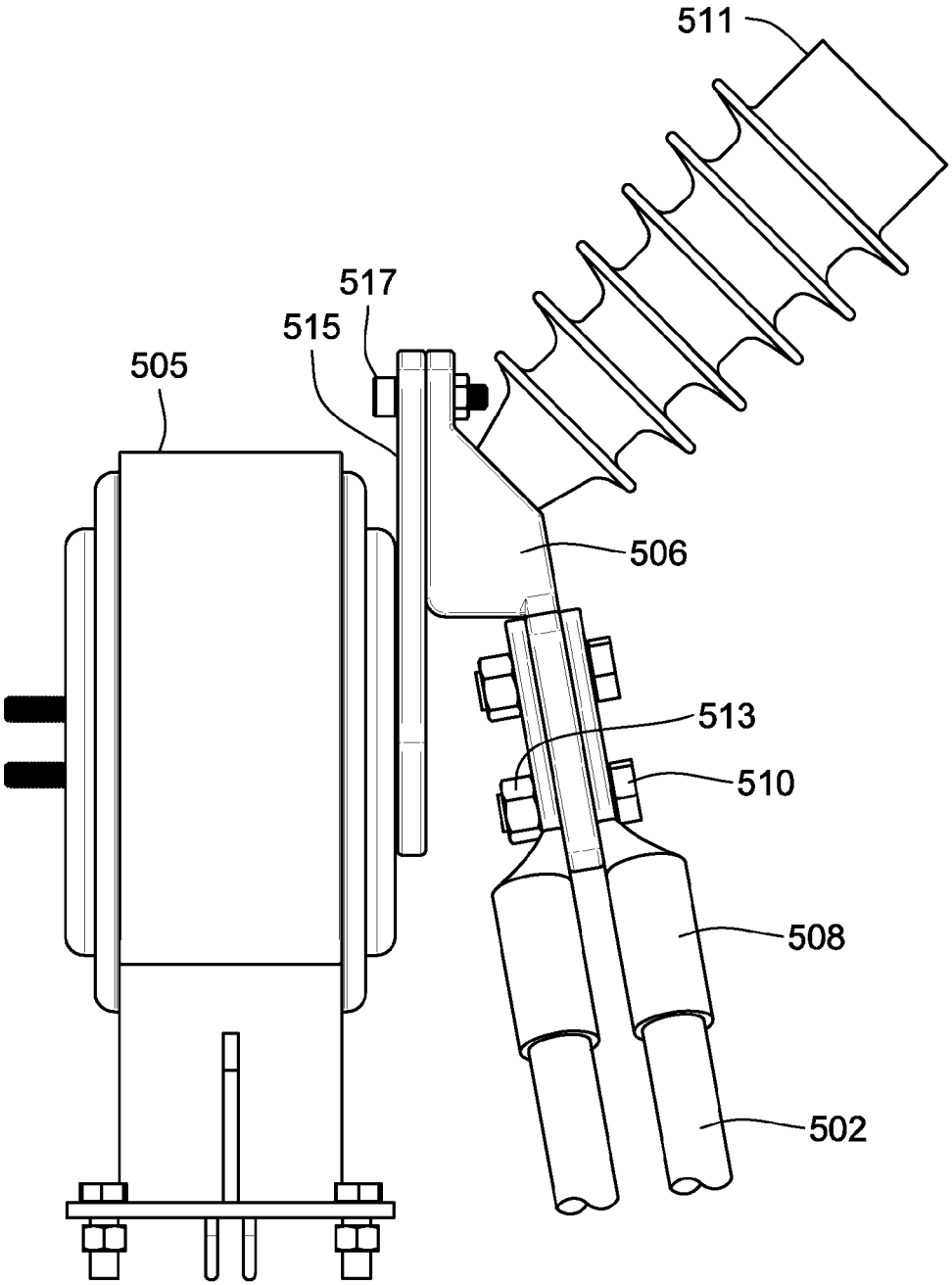
FIG. 5B is a side view of an electrical cable mounted to an electrical device via a slotted lug pad.

The slotted pad 200 includes a mounting portion 204 for mounting the slotted pad 200 to one or more electrical junctions (as illustrated in FIGS. 5A and 5B). The mounting portion 204 has a pair of main holes 206 and a secondary hole 208. The main holes 206 are intended for mounting the slotted pad 200 to an electrical device (e.g., via a bus) and the secondary hole 208 is intended for supporting a other components (e.g., an insulator).

Figure 3D:
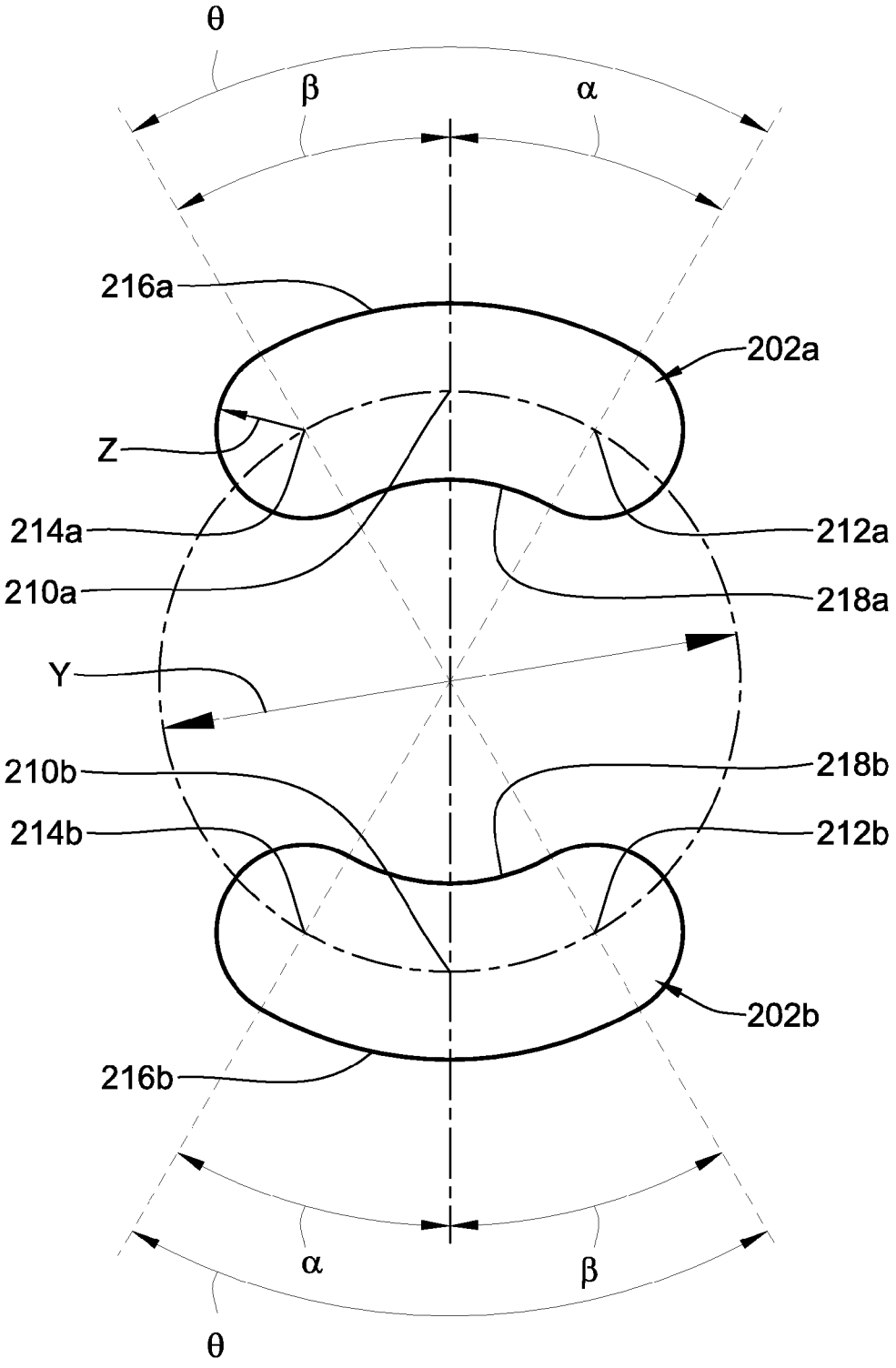
FIG. 3D is an enlarged view of a pair of radiused slotted holes.

Referring to FIG. 3D, the first pair of slotted holes 202*a*, 202*b* are symmetrically located along a diameter Y, each of the slotted holes 202*a*, 202*b* having slot centers 210*a*, 210*b* centrally located between a first end center 212*a*, 212*b* and a second end center 214*a*, 214*b*. The end centers 212*a*, 212*b*, 214*a*, 214*b* are located at a radius distance Z from the respective ends of the slotted holes 202*a*, 202*b*. The end centers 212*a*, 212*b*, 214*a*, 214*b* are further located along the circumference of the diameter Y at angles $\alpha$ and $\beta$ relative to a vertical central axis. The diameter Y is representative of a linear bolt spacing when receiving bolts (such as bolts 110 or other types of fasteners) to fasten the slotted pad 200 to a respective cable lug. According to the geometric configuration, each of the slotted holes 202*a*, 202*b* has a top radiused edge 216*a*, 216*b* and a bottom radiused edge 218*a*, 218*b*. The radiused edges allow angular adjustability when mounting an electrical cable lug to the slotted pad 200.

According to one example, the angles $\alpha$ and $\beta$ are each symmetrically angled at 30° relative to the vertical central axis, having a total angle $\theta$ of 60° between the two angles $\alpha$ and $\beta$. These angle sizes are adequate for a standard bolt spacing in which the bolt size is 0.5 inches and the bolt spacing Y is 1.75 inches.

Figure 4A:
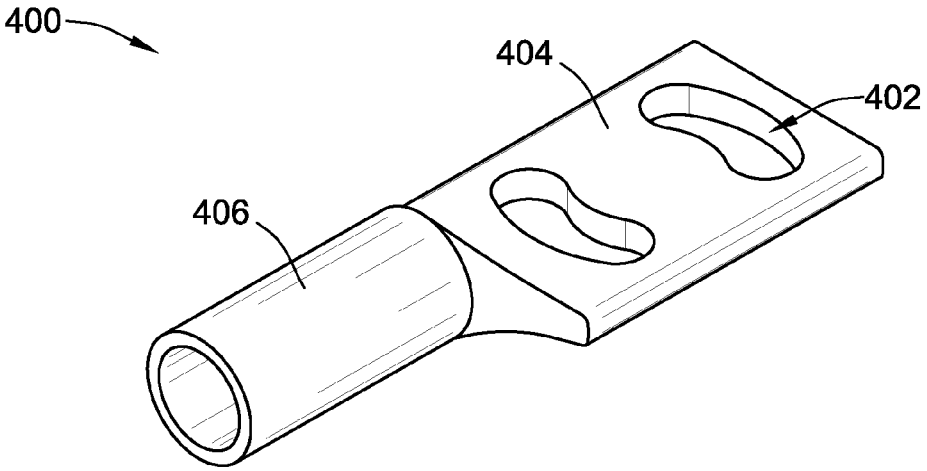
FIG. 4A is a top perspective view of a slotted cable lug.
Figure 4B:
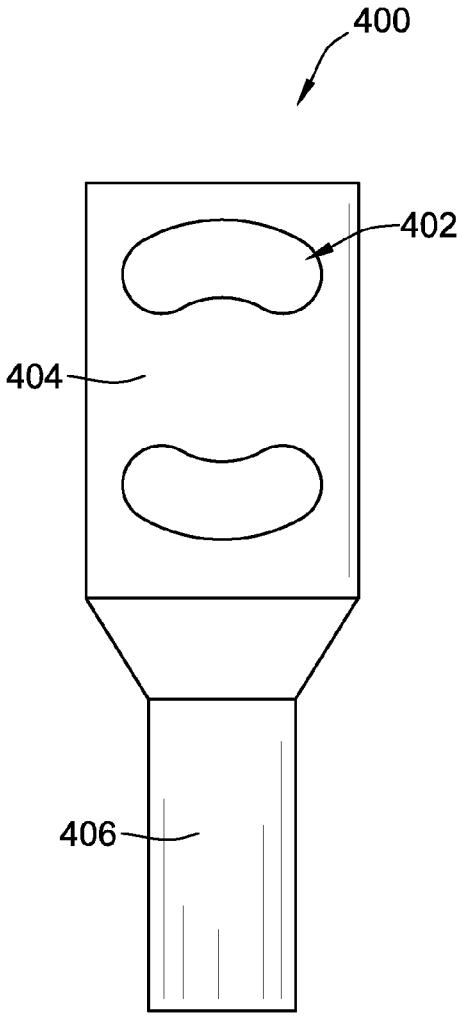
FIG. 4B is a front view of the slotted cable lug of FIG. 4A.
Figure 4C:
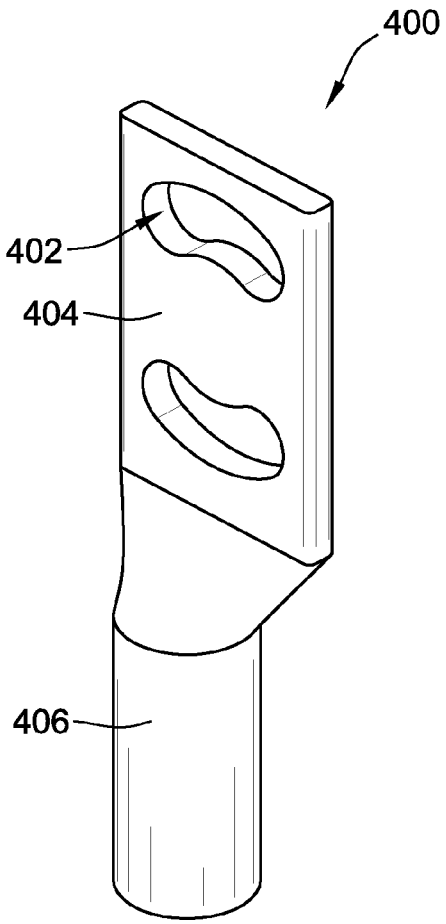
FIG. 4C is a front perspective view of the slotted cable lug of FIG. 4A.

Referring to FIGS. 4A-4C, a cable lug 400 has a plurality of radiused slotted holes 402 located in a tang portion 404 and above a cable-receiving barrel 406. In conventional cable lugs, the radiused slotted holes 402 are typically circular holes. According to this example, the slotted holes are located in the cable lug 400, instead of or in addition to having radiused slotted holes in a corresponding lug pad. The slotted holes 402 are generally similar, if not identical, to the slotted holes 202*a*, 202*b* described above in more detail in reference to FIG. 3D.

Referring to FIG. 5A, an electrical system 501 includes an electrical enclosure 500 in which a plurality of electrical cables 502 are inserted through cable conduits 504 for attachment to an electrical junction of electrical devices 505, e.g., medium voltage or low voltage electrical devices, including circuit breakers and current transformers. The cables 502 are mounted to lug pads 506 via cable lugs 508. Based on radiused slotted holes of the lug pads 506 (similar to the slotted holes 202*a*-202*d* of FIGS. 3A-3D), the cables 502 can be adjustably angled when mounted in position to the lug pads 506, e.g., angled at an angle κ between a linear portion M of a cable 502 and a vertical line N.

The lug pads are mounted to the cable lugs 508 via a plurality of bolts 510. The lug pads are further mounted to insulators 511 and, as described below, to the electrical devices 505.

Referring to FIG. 5B, a lug pad 506 serves as the mounting interface for the electrical junction of numerous components. First, the lug pad 506 is directly attached to a pair of cable lugs 508 that are mounted on opposite faces of the lug pad 506. The cable lugs 508 are secured in place using a plurality of bolts 510 and corresponding nuts 513. Second, the lug pad 506 is directly attached to a bus bar 515 using a fastener 517. The bus bar 515 is, in turn, directly attached to the current transformer 505. Third, the lug pad 506 is directly attached to, and supports, an insulator 511. In this configuration, the insulator 511 is attached using a secondary hole similar to the secondary hole 208 described above in reference to FIGS. 3A-3C.

According to other examples, a slotted pad can include other optional features. For example, one feature can include bearings to allow rotation of the cable relative to the slotted pad during installation.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An electrical system comprising:

an electrical device;

an electrical cable coupled to an electrical junction of the electrical device via a cable lug, the cable lug having a barrel in which an end of an electrical cable is insertably attached, the cable lug having at least two lug holes;

a lug pad for attaching the cable lug to the electrical device, the lug pad having at least two pad holes, each of the pad holes being aligned with a respective one of the lug holes, at least one of either the lug holes or the pad holes being a slotted hole for permitting angular adjustable positioning of the cable lug relative to the lug pad throughout a plurality of mountable positions; and at least two fasteners for mounting the cable lug to the lug pad such that the barrel of the cable lug is angled relative to a linear distance between the two pad holes.

2. The electrical system of claim 1, wherein the electrical device is selected from a group consisting of medium voltage and low voltage electrical devices.

3. The electrical system of claim 1, wherein the electrical cable is inserted into an electrical enclosure through a cable conduit having a linear portion, the cable lug being angled non-linearly relative to the linear portion of the cable conduit when attached to the lug pad.

4. The electrical system of claim 1, wherein both lug holes are slotted holes.

5. The electrical system of claim 1, wherein both pad holes are slotted holes.

6. The electrical system of claim 1, wherein the slotted hole has a radiused shape.

7. The electrical system of claim 1, wherein both holes of either the lug holes or the pad holes have a radiused shape, the radiused shape of one of the holes being symmetrical to the radiused shape of another of the holes.

8. The electrical system of claim 1, wherein the lug pad has four pad holes symmetrically arranged in a matrix pattern of two rows and two columns, each of the pad holes having a radiused shape.

9. The electrical system of claim 1, wherein the lug pad further includes a mounting portion for securing an insulator to the electrical device, the mounting portion including one or more mounting holes.

10. An electrical system comprising:

an electrical device;

a cable lug attached to the electrical cable, the cable lug having a barrel in which an end of the electrical cable is insertably attached, the cable lug having a tang with at least two holes;

a lug pad having at least two slotted holes with a radiused shape, the slotted holes being symmetrically oriented on the lug pad and permitting angular adjustment of the cable lug relative to the lug pad throughout a plurality of mountable positions; and at least two fasteners for mounting the cable lug to the lug pad such that the barrel of the cable lug is angled relative to a linear distance between the slotted holes.

11. The electrical system of claim 10, wherein the electrical device is selected from a group consisting of medium voltage and low voltage electrical devices.

12. The electrical system of claim 10, wherein the lug pad has four slotted holes symmetrically arranged in a matrix pattern of two rows and two columns, each of the slotted holes having a radiused shape.

13. The electrical system of claim 10, wherein the lug pad further includes a mounting portion for securing an insulator to the electrical device, the mounting portion including one or more mounting holes.

14. The electrical system of claim 10, further comprising a cubicle for receiving an electrical cable through a cable conduit, the cable conduit having a linear portion aligned with the linear distance between the slotted holes.

* * * * *